US011335471B1

(12) United States Patent
Kim et al.

(10) Patent No.: US 11,335,471 B1
(45) Date of Patent: May 17, 2022

(54) SYSTEM FOR CLOSING DRUM UNIT FOR STORING RADIOACTIVE WASTE

(71) Applicant: JS CHEM CORPORATION, Jeollabuk-do (KR)

(72) Inventors: Yong Hyun Kim, Wanju-gun (KR); Seok Hee Im, Wanju-gun (KR); Dong Hoon Oh, Wanju-gun (KR); Kyoung Hwan Joung, Wanju-gun (KR); Seong Kyun Im, Wanju-gun (KR)

(73) Assignee: JS CHEM CORPORATION, Wanju-gun (KR)

( * ) Notice: Subject to any disclaimer, the term of this patent is extended or adjusted under 35 U.S.C. 154(b) by 0 days.

(21) Appl. No.: 17/384,185

(22) Filed: Jul. 23, 2021

(30) Foreign Application Priority Data

Jun. 8, 2021 (KR) ..... 10-2021-0074119

(51) Int. Cl.
*G21F 5/12* (2006.01)
*G21F 9/36* (2006.01)

(52) U.S. Cl.
CPC . *G21F 5/12* (2013.01); *G21F 9/36* (2013.01)

(58) Field of Classification Search
CPC ..... G21F 5/12; G21F 9/36
USPC ..... 376/272
See application file for complete search history.

(56) References Cited

FOREIGN PATENT DOCUMENTS

| | | | |
|---|---|---|---|
| JP | 6000799 | B | 10/2016 |
| KR | 10-2008-0052925 | A | 6/2008 |
| KR | 10-1146176 | B1 | 5/2012 |
| KR | 10-2017-0112397 | A | 10/2017 |
| KR | 10-2019-002245 | A | 3/2019 |
| KR | 10-1996945 | B1 | 10/2019 |
| KR | 10-2252372 | B1 | 5/2021 |
| KR | 10-2252383 | B1 | 5/2021 |

OTHER PUBLICATIONS

Decision to Grant a Patent dated Sep. 23, 2021 for related Korean Patent Application No. 10-2021-0074119.

*Primary Examiner* — Edward M Johnson
(74) *Attorney, Agent, or Firm* — Sughrue Mion, PLLC

(57) ABSTRACT

Proposed is a system for closing a drum unit for storing radioactive waste, the system including: a supporting unit configured to be seated on the ground; a drum unit configured to be seated on a top part of the supporting unit and having a plurality of first fastening holes; a moving unit configured to move to a side of the drum unit; a cover unit provided at the inside of the moving unit or at one side of the drum unit and having a plurality of second fastening holes; tightening units configured to be inserted into the associated second fastening holes; a fastening unit configured to grip the cover unit through a gripping part to move the cover unit to the top part of the drum unit simultaneously, thereby closing a gap between the drum unit and the cover unit; and a controller configured to control the fastening unit.

8 Claims, 8 Drawing Sheets

SYSTEM FOR CLOSING DRUM UNIT FOR STORING RADIOACTIVE WASTE

CROSS REFERENCE TO RELATED APPLICATION

The present application claims priority to Korean Patent Application No. 10-2021-0074119, filed Jun. 8, 2021, the entire contents of which is incorporated herein for all purposes by this reference.

BACKGROUND OF THE INVENTION

Field of the Invention

The present disclosure relates to a system for closing a drum unit for storing radioactive waste and, more particularly, to a system for closing a drum unit for storing radioactive waste, the system being configured to unmannedly close a top part of the drum unit for storing the radioactive waste through tightening units provided in a cover unit.

Description of the Related Art

In general, the amount of radioactive waste generated from nuclear power plants, research institutes, or the like is very small compared to that of household or industrial waste, but a fatal risk of radiation leakage is high and a treatment period is very long, so safety in a post-treatment process thereof is required to be secured. Treatment of radioactive waste is a method to reduce an effect of radiation on the environment, wherein the method solidifies the radioactive waste using a polymer, paraffin, cement, or the like. Here, radioactive liquid waste of the radioactive waste is made into granulated radioactive waste by concentrating and drying a large amount of moisture contained therein. Subsequently, the granulated radioactive waste is placed in a specified drum unit and is subject to solidification treatment by injecting a solidifying agent (solidifying resin) such as polymer, paraffin, cement, or the like into an inner side of the drum unit.

On the other hand, in order to close the drum unit after injecting the radioactive waste into the drum unit, closure of the drum unit is performed by applying a mobile unmanned system to prevent workers from being exposed.

At this time, in a process of closing a cover unit on a top part of the drum unit to block the radioactive waste after injecting the radioactive waste into the inner side of the drum unit, concerns are being raised due to serious problems that precise closure may not be made between the top part of the drum unit and the cover unit, so a trace amount of radioactivity may leak between the top part of the drum unit and the cover unit.

Accordingly, research on a device for safely and unmannedly closing the drum unit containing the radioactive waste therein is being actively conducted.

DOCUMENTS OF RELATED ART

Patent Document (Patent Document 1) Korean Patent No. 10-1146176

SUMMARY OF THE INVENTION

Accordingly, the present disclosure has been made keeping in mind the above problems occurring in the related art, and an objective of the present disclosure is to provide a system for closing a drum unit for storing radioactive waste, the system being configured to unmannedly close a top part of the drum unit for storing the radioactive waste through each of tightening units provided in a cover unit.

Another objective of the present disclosure is to provide the system for closing the drum unit for storing radioactive waste for performing precisely fastening each of tightening units through a pair of keys and a pair of key grooves when each of the tool parts rotates to tighten each of the fastening bolts.

The objectives of embodiments of the present disclosure are not limited to the above-mentioned objectives, and other objectives not mentioned will be clearly understood by those of ordinary skill in the art to which the present disclosure belongs from the following description.

In order to achieve the above objective, according to one aspect of the present disclosure, there may be provided a system for closing a drum unit for storing radioactive waste, the system including: a supporting unit configured to be seated on the ground; a drum unit configured to be seated on a top part of the supporting unit and having a plurality of first fastening holes formed along an outer circumferential surface of a top part thereof; a moving unit configured to move to a side of the drum unit; a cover unit provided at an inside of the moving unit or at one side of the drum unit and having a plurality of second fastening holes formed along an outer circumferential surface thereof; tightening units configured to be inserted into the corresponding second fastening holes; a fastening unit configured to grip the cover unit through a gripping part provided on one side of the inside of the moving unit to move the cover unit to the top part of the drum unit simultaneously and to allow the cover unit to be seated by aligning axis lines of the first and second fastening holes to be matched, thereby closing a gap between the drum unit and the cover unit by tightening an upper part of each of the tightening units through associated one of a plurality of tool parts provided on a circumference of the gripping part; and a controller configured to control the fastening unit.

In addition, according to an embodiment of the present disclosure, there may be provided a system for closing a drum unit for storing radioactive waste, wherein each of the tightening units may include: a fastening bolt having a bolt head formed on an upper part thereof and a first screw thread formed on a lower part thereof; a first bushing having: a hollow first insertion portion into which the fastening bolt is inserted; a first step formed under the first insertion portion; and first latching portions formed so as to be symmetrical to each other in front and rear directions at a bottom part of the first step; a second bushing having: a hollow second insertion portion, into which outer circumferential surfaces of the first latching portions are inserted, and having a top part thereof being latched on the first step; and a plurality of fixing pieces formed into a plurality of incision portions on a circumference of a lower part of the second insertion portion; and a third bushing having: second latching portions formed so as to be symmetrical to each other in left and right directions at an upper part thereof, and inserted into the first latching portions; a second step formed at a side under the second latching portions; and a third hollow insertion portion formed under the second step.

In addition, according to an embodiment of the present disclosure, there may be provided a system for closing a drum unit for storing radioactive waste, wherein, when one of the tool parts tightens the bolt head, the third insertion portion formed with a second screw thread on an inner circumferential surface thereof may move to an upper part of the fastening bolt along the first screw thread, and at the same time, the second step may press a bottom part of each of the fixing pieces, and each of the fixing pieces may subsequently spread outward with a boundary line, which is formed at an upper end of each of the incision portions, as a reference, so as to surround an area around a bottom part of the first fastening hole, whereby the drum unit and the cover unit may be closed.

In addition, according to an embodiment of the present disclosure, there may be provided a system for closing a drum unit for storing radioactive waste, wherein the second step may be configured to be tapered at a predetermined angle in a direction from a bottom part to a top part.

In addition, according to an embodiment of the present disclosure, there may be provided a system for closing a drum unit for storing radioactive waste, wherein a pair of keys may be provided at a lower end of each of the tool parts, and a pair of key grooves into which the pair of keys are inserted may be provided on an outer circumferential surface of an upper part of the first insertion portion.

In addition, according to an embodiment of the present disclosure, there may be provided a system for closing a drum unit for storing radioactive waste, the system further including an injection unit provided on the one side of the inside of the moving unit and configured to receive the radioactive waste from an outside to inject the radioactive waste into the drum unit.

In addition, according to an embodiment of the present disclosure, there may be provided a system for closing a drum unit for storing radioactive waste, wherein the controller may control positions of the fastening unit and the injection unit so as to move the fastening unit and the injection unit to a position where the drum unit may be seated.

In addition, according to an embodiment of the present disclosure, there may be provided a system for closing a drum unit for storing radioactive waste, wherein the gripping part may be provided with an electromagnet, and the cover unit may be made of steel material so that the gripping part may grip a top part of the cover unit by a magnetic force of the electromagnet.

According to the system for closing the drum unit for storing radioactive waste of the present disclosure, there is an effect in that the top part of the drum unit for storing the radioactive waste can be unmannedly closed through the tightening units provided in the cover unit.

In addition, when each of the tool parts rotates to tighten each of the fastening bolts, there is an effect in that precise fastening of each of the tightening units can be performed through a pair of keys and a pair of key grooves.

BRIEF DESCRIPTION OF THE DRAWINGS

The above and other objectives, features, other advantages of the present disclosure will be more clearly understood from the following detailed description when taken in conjunction with the accompanying drawings, in which.

DETAILED DESCRIPTION OF THE INVENTION

The following objectives, other objectives, features, and advantages of the present disclosure will be readily understood through the following exemplary embodiments related to the accompanying drawings. However, the present disclosure is not limited to the embodiments described herein and may be embodied in other forms.

Meanwhile, the embodiments introduced herein are provided in order to allow the disclosed subject matter to be thorough and complete and the spirit of the present disclosure to be sufficiently conveyed to those skilled in the art.

The embodiments described and illustrated herein also include complementary embodiments thereof.

In the present specification, the singular also includes the plural, unless specifically stated otherwise in a phrase. As used herein, the terms "comprise" and/or "comprising" do not exclude the presence or addition of one or more other components. Hereinafter, the present disclosure will be described in detail with reference to the drawings. In describing the specific embodiments below, various specific contents have been prepared to more specifically explain and help the understanding of the disclosure. However, those skilled in the art and having the knowledge to a degree to understand the present disclosure may recognize that the embodiments may be used even without such various specific details. In some cases, it is mentioned in advance that parts, which are commonly known in describing the disclosure but not largely related to the disclosure, may not be described in describing the present disclosure in order to avoid confusion.

Figure 1:
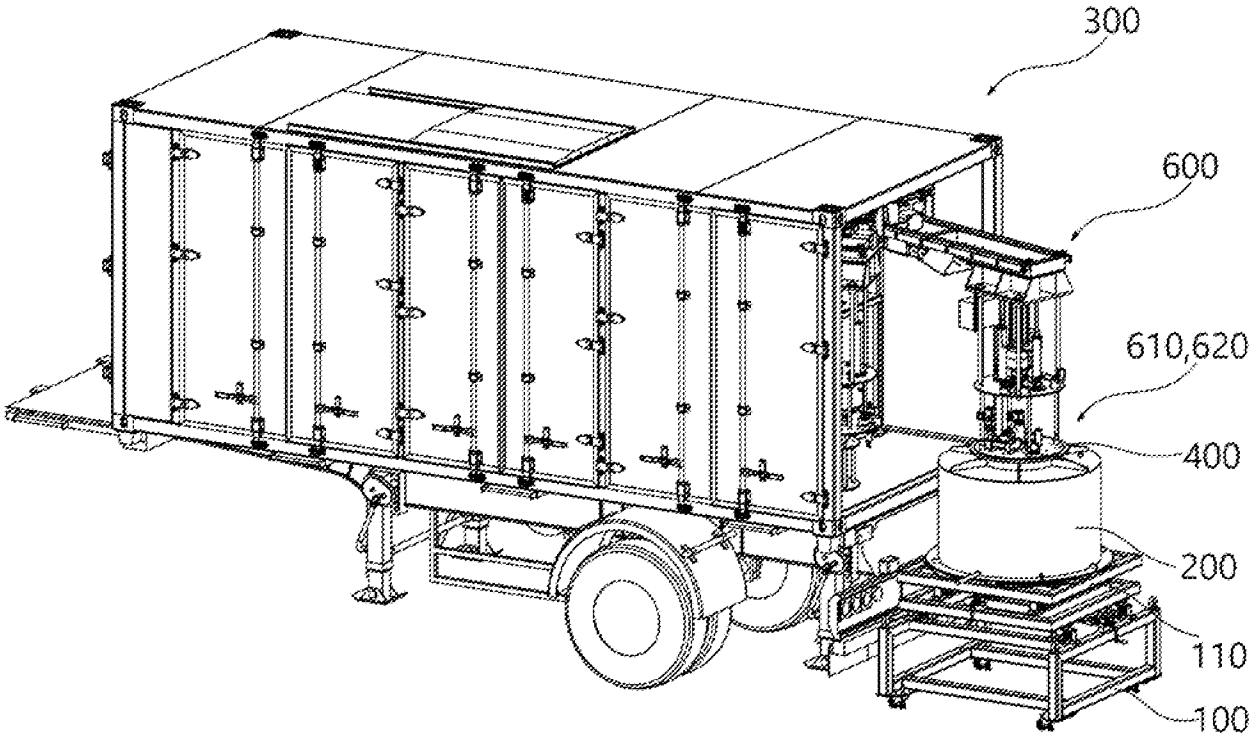
FIGS. 1 to 2 are perspective views showing a system for closing a drum unit for storing radioactive waste according to an embodiment of the present disclosure.
Figure 2:
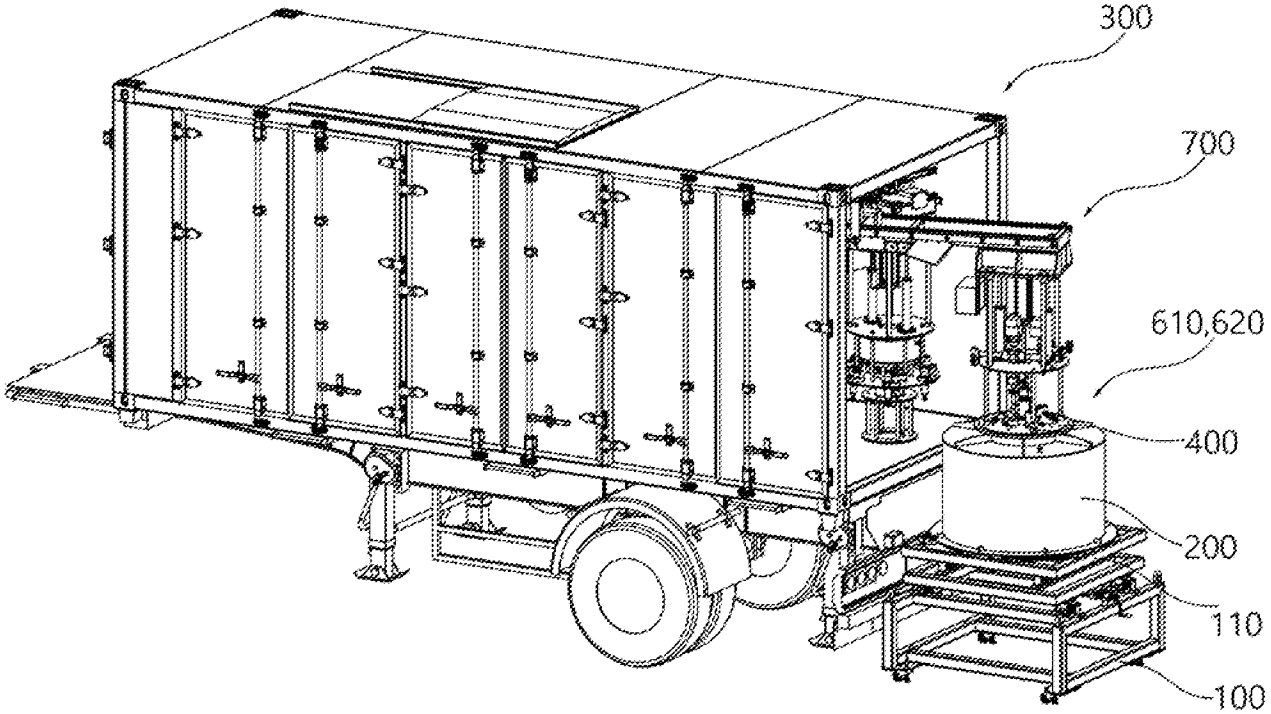
Figure 3:
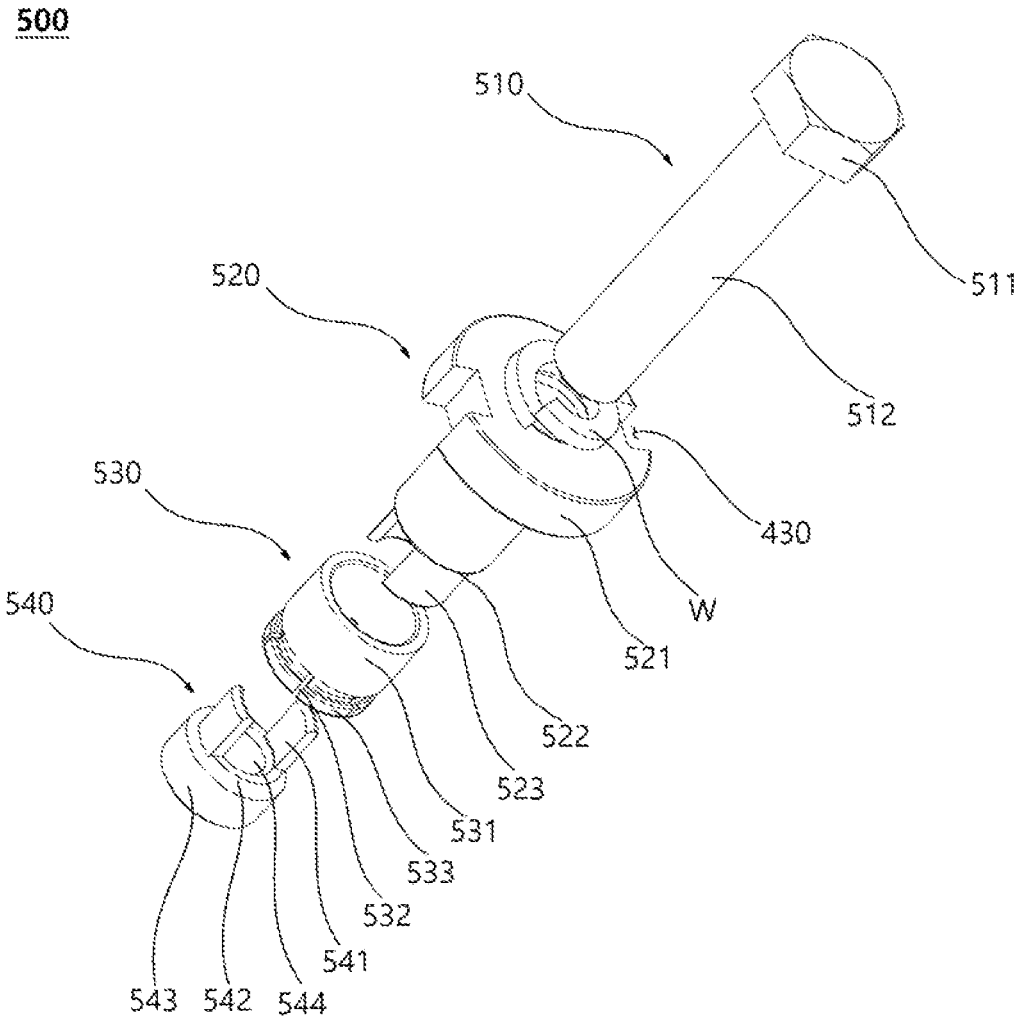
FIG. 3 is an exploded perspective view showing one of tightening units of the system for closing the drum unit for storing radioactive waste according to the embodiment of the present disclosure.
Figure 4:
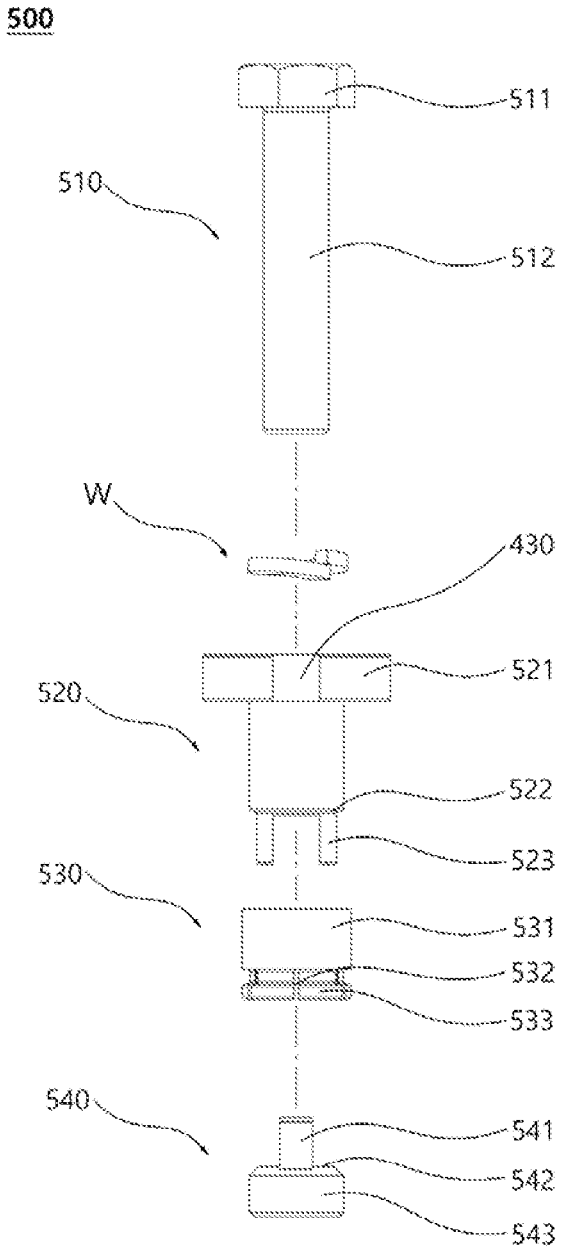
FIG. 4 is a front view showing an exploded state of the one of the tightening units configured in the system for closing the drum unit for storing radioactive waste according to the embodiment of the present disclosure.
Figure 5:
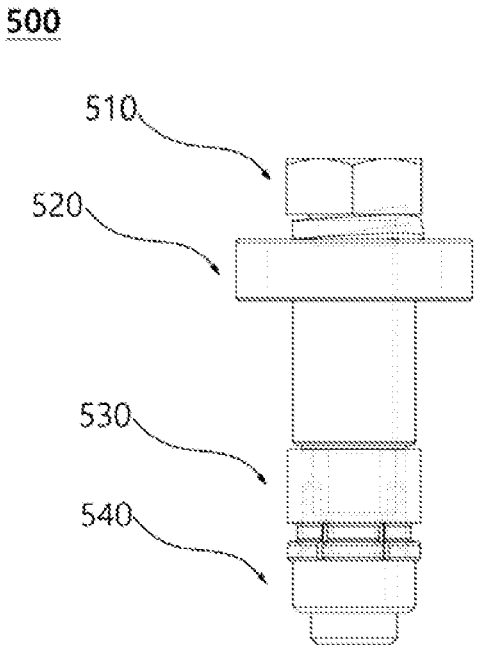
FIG. 5 is a front view showing a coupled state of the one of the tightening units configured in the system for closing the container unit for storing radioactive waste according to an embodiment of the present disclosure.
Figure 6:
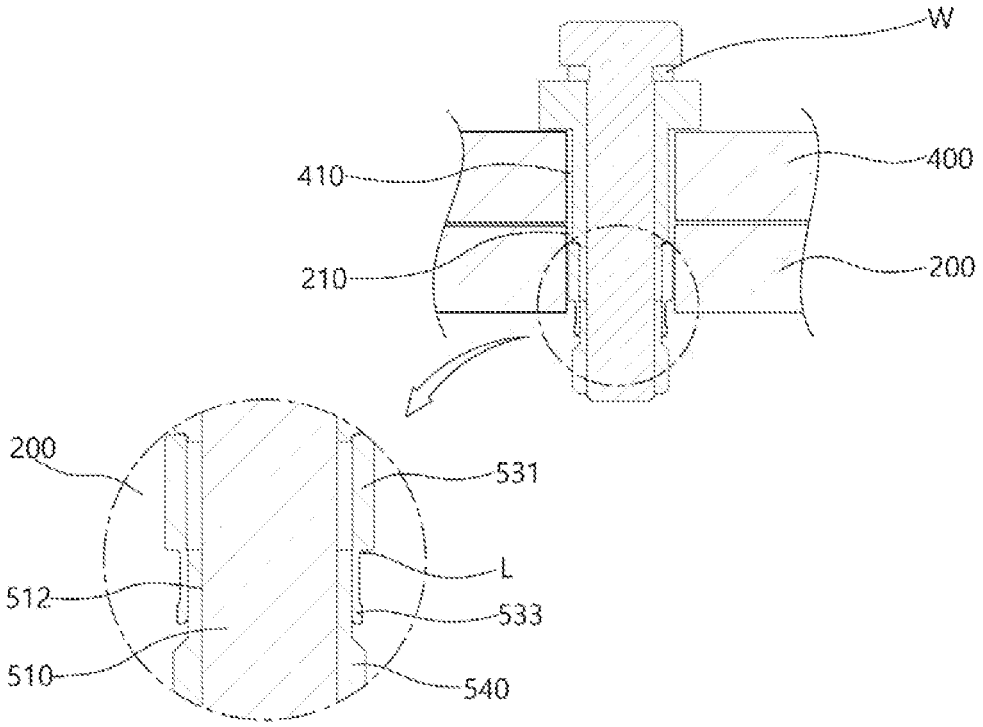
FIG. 6 is a partially enlarged view showing a state before the drum unit and the cover unit are closed in the system for closing the drum unit for storing radioactive waste according to the embodiment of the present disclosure.
Figure 7:
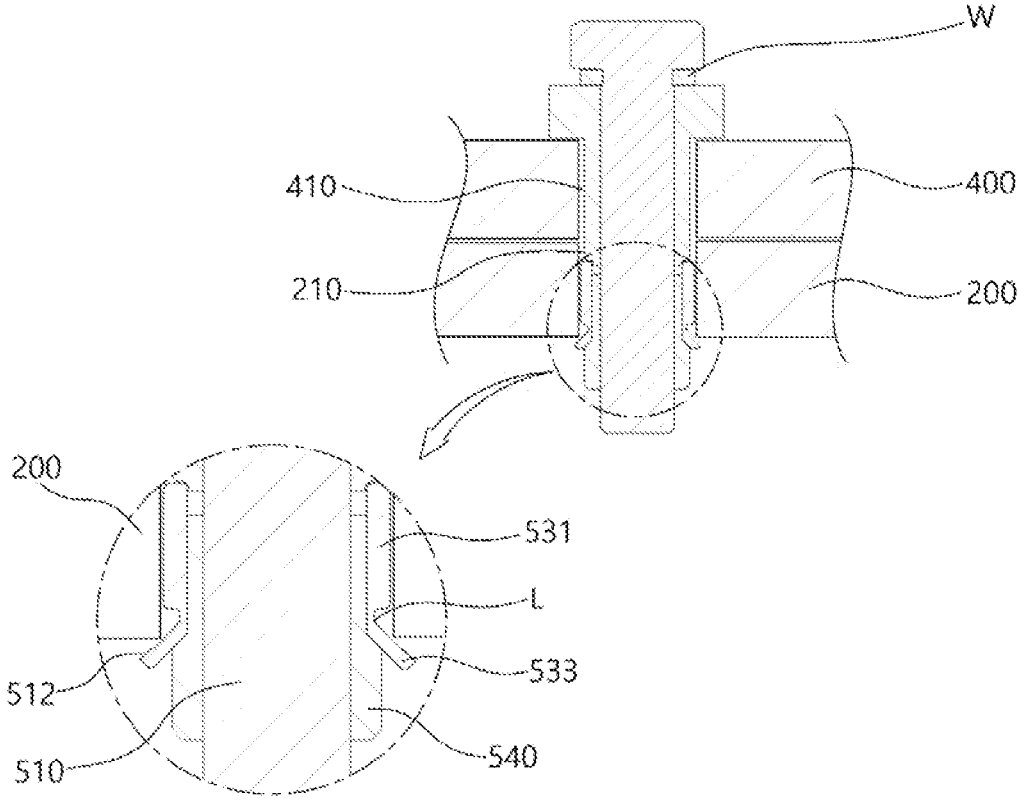
FIG. 7 is a partially enlarged view showing a state after the drum unit and the cover unit are closed in the system for closing the drum unit for storing radioactive waste according to the embodiment of the present disclosure.
Figure 8:
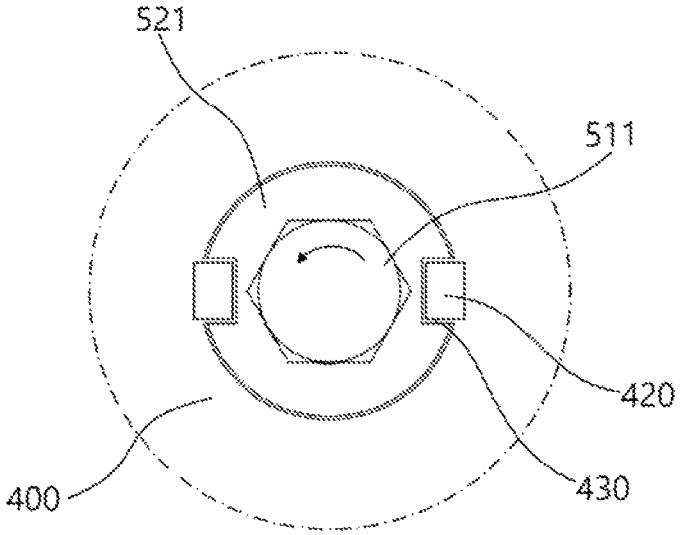
FIG. 8 is a plan view showing a coupled state of a pair of keys and a pair of key grooves in the system for closing the drum unit for storing radioactive waste according to the embodiment of the present disclosure.

FIGS. 1 to 2 are perspective views showing a system for closing a drum unit for storing radioactive waste according to an embodiment of the present disclosure, FIG. 3 is an exploded perspective view showing one of tightening units of the system for closing the drum unit for storing radioactive waste according to the embodiment of the present disclosure, FIG. 4 is a front view showing an exploded state of the one of the tightening units configured in the system for closing the drum unit for storing radioactive waste according to the embodiment of the present disclosure, FIG. 5 is a front view showing a coupled state of the one of the tightening units configured in the system for closing the container unit for storing radioactive waste according to an embodiment of the present disclosure, FIG. 6 is a partially enlarged view showing a state before the drum unit and the cover unit are closed in the system for closing the drum unit for storing radioactive waste according to the embodiment of the present disclosure, FIG. 7 is a partially enlarged view showing a state after the drum unit and the cover unit are closed in the system for closing the drum unit for storing radioactive waste according to the embodiment of the present disclosure, and FIG. 8 is a plan view showing a coupled state of a pair of keys and a pair of key grooves in the system for closing the drum unit for storing radioactive waste according to the embodiment of the present disclosure.

As shown in FIGS. 1 to 8, the system for closing the drum unit for storing radioactive waste according to the present disclosure includes largely, a supporting unit 100, a drum unit 200, a moving unit 300, a cover unit 400, tightening units 500, a fastening unit 600, and a controller (not shown).

More specifically, the system for closing the drum unit for storing radioactive waste according to the present disclosure includes: a supporting unit 100 configured to be seated on the ground; a drum unit 200 configured to be seated on a top part of the supporting unit 100 and having a plurality of first fastening holes 210 formed along an outer circumferential surface of a top part thereof; a moving unit 300 configured to move to a side of the drum unit 200; a cover unit 400 provided at an inside of the moving unit 300 or at one side of the drum unit 200 and having a plurality of second fastening holes 410 formed along an outer circumferential surface thereof; tightening units 500 configured to be inserted into the associated second fastening holes 410; a fastening unit 600 configured to grip the cover unit 400 through a gripping part 610 provided on one side of the inside of the moving unit 300 to move the cover unit 400 to the top part of the drum unit 200 simultaneously and to allow the cover unit 400 to be seated by aligning axis lines of the first and second fastening holes 210 and 410 to be matched, thereby closing a gap between the drum unit 200 and the cover unit 400 by tightening an upper part of each of the tightening units 500 through associated one of a plurality of tool parts 620 provided on a circumference of the gripping part 610; and a controller configured to control the fastening unit 600.

First, the supporting unit 100 is configured to be seated on the ground of a radioactive waste disposal site and the like, wherein the supporting unit 100 may be adjusted to be horizontal with the ground.

Through this, the supporting unit 100 prevents the drum unit 200, which will be described below, from being turned upside down by being tilted to any one side. When the supporting unit 100 is not leveled with the ground, in a process of injecting the radioactive waste into the drum unit 200 or after the radioactive waste has been injected into the drum unit 200, the drum unit 200 may be turned upside down because an axis line of the center of gravity thereof does not match vertically with a bottom surface thereof, and at the same time, the radioactive waste may leak. Therefore, in order to prevent such a problem, a top part surface of the supporting unit 100 may be provided to be parallel to the ground.

In addition, the supporting unit 100 is manufactured in a structure in which pipes having a cross-section of a circular shape or square shape are coupled in horizontal and vertical directions, thereby supporting the load of the drum unit 200.

In addition, the auxiliary supporting unit 110 may be further seated on and fixed to the top part of the supporting unit 100, wherein the auxiliary supporting unit 110 may be seated on and fixed to the top part of the supporting unit 100 with various heights, by taking into consideration a height between the bottom part of the fastening unit 600 to be described below and the top part of the drum unit 200, thereby being used as a means of supporting regardless of the height of the drum unit 200.

The drum unit 200 is configured to be seated on the top part of the supporting unit 100 and to store radioactive waste generated in a radioactive waste disposal site and the like.

Here, the radioactive waste, mixed materials, and the like are injected into the drum unit 200, and the radioactive waste may be injected through the injection unit 700, wherein the injection unit 700 is provided on one side of the inner side of the moving unit 300 to be described below and is configured to inject the radioactive waste into the drum unit 200 by receiving the radioactive waste from the outside.

Here, the drum unit 200 may be manufactured in a drum shape having a cross-section such as a circle or square shape and may be manufactured to have various sizes, thereby receiving the radioactive waste.

In addition, the drum unit 200 is formed with a plurality of first fastening holes 210 along the outer circumferential surface of the top part thereof, wherein the first fastening holes 210 are formed by being spaced apart from each other at regular intervals along the outer circumferential surface of the top part of the drum unit 200.

In addition, after position adjustment (alignment of an axis line) of each of the first fastening holes 210 is made to correspond to each of the second fastening holes 410, each of the tightening units 500 to be described below is penetrated through and inserted into the associated one of the first fastening holes 210.

On the other hand, a step (not shown) may be formed on an outer circumferential surface of the top part of the drum unit 200, thereby improving closing force with the cover unit 400 to be described below, and a sealing material (not shown) may be provided on an outer circumferential surface of the step (not shown), thereby improving the closing force between the drum unit 200, along with the step (not shown), and the cover unit 400.

The moving unit 300 is configured to move to a side of the drum unit 200.

Here, the moving unit 300 is a means to be used for unmanned operation at a radioactive waste disposal site after being moved to a radioactive waste disposal site located in various places, and it is implied that the moving unit 300 includes all moving means capable of loading such as a trailer, a cargo truck, and the like.

On the other hand, the gripping part 610, the tool parts 620, and the like to be described below are loaded at the inside of the moving unit 300, thereby being allowed to move to a position where the drum unit 200 into which the radioactive waste has been injected has been seated.

Here, the moving unit 300 is positioned by being spaced apart at a regular interval from the center of the drum unit 200 and may be positioned within an operating range of the fastening unit 600 and the injection unit 700 to be described below.

The cover unit 400 is provided at the inside of the moving unit 300 or at one side of the drum unit 200 and is configured to close the top part of the drum unit 200.

The cover unit 400 may be manufactured to have a cross-section in a cover shape such as a circle shape, a square shape, or the like and to have various sizes, thereby closing the top part of the drum unit 200.

In addition, the cover unit 400 is formed with the plurality of second fastening holes 410 along the outer circumferential surface thereof, wherein the second fastening holes 410 are formed by being spaced apart from each other at regular intervals along the outer circumferential surface of the cover unit 400.

In addition, after position adjustment (alignment of an axis line) of each of the second fastening holes 410 is made to correspond to each of the first fastening holes 210, each of the tightening units 500 to be described below is penetrated through and inserted into the associated one of the second fastening holes 410.

On the other hand, a step (not shown) is formed on an outer circumferential surface of a bottom part of the cover unit 400 to correspond to the step (not shown) formed on the circumferential surface of the top part of the container part 200, thereby improving the closing force between the drum unit 200 and the cover unit, and a sealing material (not shown) may be provided on the outer circumferential surface of the step (not shown), thereby improving the closing force between the drum unit 200, along with the step (not shown), and the cover unit 400. On the other hand, the cover unit 400 is made of steel material (material that responds to magnetic force) and may be moved to the top part of the drum unit 200 in a state of the top part thereof being gripped by the gripping part 610, which will be described below, through whether current is supplied to the gripping part 610.

Each of the tightening units 500 is configured to be inserted into associated one of the second fastening holes 410.

Furthermore, in a standby state, each of the tightening units 500 has been inserted into the associated one of the second fastening holes 410 of the cover unit 400. When the cover unit 400 is seated on the drum unit 200 for closing the drum unit 200, axis lines of each of the first fastening holes 210 and each of the second fastening holes 410 are aligned to be matched, so that a lower part of each of the tightening units 500 is inserted into the associated one of the first fastening holes 210.

Here, each of the tightening units 500 may mutually close the drum unit 200 and the cover unit 400 through the associated one of the tool parts 620 configured in the fastening unit 600 to be described below.

The tightening units 500 will be described in detail below.

The fastening unit 600 is configured to include a gripping part 610 provided on one side of the inside of the moving unit 300 and the tool parts 620 provided on the circumference of the gripping part 610.

More specifically, the fastening unit 600 is configured: to grip the cover unit 400 through the gripping part 610 provided on one side of the inside of the moving unit 300 and to move the cover unit 400 to the top part of the drum unit 200, at the same time, thereby allowing the cover unit 400 to be seated by arranging the axis lines of each of the first fastening holes 210 and associated one of the second fastening holes 410 to be matched; and to close the gap between the drum unit 200 and the cover unit 400 by tightening an upper part of each of the tightening units 500 through associated one of a plurality of tool parts 620 provided around the gripping part 610.

The gripping part 610 is provided with an electromagnet, and the cover unit is made of steel material to correspond to the gripping part 610. Accordingly, the gripping part 610 may grip the upper part of the cover unit 400 by the magnetic force of the electromagnet.

That is, the electromagnet is connected to a separately provided power supply unit (not shown) to receive current and, when the current flows, the gripping part 610 is magnetized, so that the gripping part 610 may grip the top part of the cover unit 400 to move the cover unit 400 to the top part of the drum unit 200. In addition, when the current is cut off, the electromagnet returns to an original non-magnetized state, thereby allowing the cover unit 400 to be seated on the top part of the drum unit 200.

Here, the fastening unit 600 is manufactured to be movable in front, back, left and right, and up and down directions through the control of the controller (not shown) to be described below and, after gripping the top part of the cover unit 400, may move to be matched with a position of the drum unit 200.

Each of the tool parts 620 is configured to close the cover unit 400 that has been moved to the top part of the drum unit 200 through the gripping part 610.

Each of the tool parts 620 is to be rotated by receiving a fluid supplied from the outside through a fluid supply means (not shown), wherein each of the tool parts 620 may be an electric drill.

Here, a chamber (not shown) configured to collect the supplied fluid may be further included between the fluid supply means (not shown) and each of the tool parts 620.

More specifically, the chamber (not shown) is connected to one side of the fluid supply means (not shown) to always collect the fluid supplied from the fluid supply means (not shown) and may supply the collected fluid to each of the tool parts. Accordingly, the shortage of fluid supply may be solved, thereby promoting an operation of each of the tool parts 620.

On the other hand, each of the tool parts 620 is configured to tighten associated one of the tightening units 500 to be inserted into the cover unit 400. When each of the tool parts 620 grips the upper part of associated one of the fastening bolts 510, which will be described below, and rotates the associated one of the fastening bolts 510 to tighten, one side of the lower part of the associated one of the tightening units 500 surrounds a circumferential area around a bottom part of each of the first fastening holes 210, thereby closing the gap between the cover unit 400 and the drum unit 200.

In this case, a magnet may be installed at an end of each of the tool parts 620 and grip a top part of the first bushing 520, which will be described below.

Each of the above-stated tightening units 500 is configured to largely include a fastening bolt 510, a first bushing 520, a second bushing 530, and a third bushing 540.

More specifically, the fastening bolt 510 is configured to include a bolt head 511 formed on an upper part thereof and a first screw thread 512 formed on a lower part thereof.

The first bushing 520 is configured to include a hollow first insertion portion 521 into which the fastening bolt 510 is inserted, a first step 522 formed under the first insertion portion 521, and first latching portions 523 formed so as to be symmetrical to each other in front and rear directions at a bottom part of the first step 522.

The second bushing 530 is configured to include a hollow second insertion portion 531 into which the outer circumferential surface of the first engaging portions 523 is inserted and a plurality of fixing pieces 533 configured as a plurality of incision portions 532 at a lower part of the second insertion portion 531.

The third bushing 540 is configured to include: second latching portions 541 formed so as to be symmetrical to each other in left and right directions at an upper part thereof, thereby being inserted into the first latching portions 523; a second step 542 formed at a part under the second latching portions 541; and a third hollow insertion portion 543 formed under the second step 542.

That is, when one of the tool parts 620 tightens the bolt head 511, the third insertion portion 543 formed with a second screw thread 544 on an inner circumferential surface thereof moves to an upper part of the fastening bolt 510 along the first screw thread 512, and at the same time, the second step 542 presses a bottom part of each of the fixing pieces 533, and each of the fixing pieces 533 subsequently spreads outward with a boundary line L, which is formed at an upper end of each of the incision portions 532, as a reference so as to surround an area around a lower part of one of the first fastening holes 210, whereby the drum unit and the cover unit are closed.

On the other hand, a protrusion 534 protruding outward is provided at a lower end of each of the fixing pieces 533.

When each of the fixing pieces 533 spreads outward with the boundary line L as the reference, each of the protrusions 534 latches and supports a spot around the bottom part of one of the first fastening holes 210, thereby enhancing closing force between the cover unit 400 and the drum unit 200.

In addition, the second step 542 is configured to be tapered at a predetermined angle in a direction from a bottom part to a top part. Accordingly, when the third bushing 540 presses the bottom part of each of the fixing pieces 533, each of the fixing pieces 533 may be induced to be smoothly spread outward with the boundary line L as the reference.

In addition, a pair of keys 420 are provided at a bottom part of each of the tool parts 620, and a pair of key grooves 430 into which the pair of keys 420 are inserted are provided on an outer circumferential surface of an upper part of the first insertion unit 521.

Here, when each of the bolts 510 is being fastened by being rotated by associated one of the tool parts 620, each of the tightening units 500 may be prevented from being shaken through the pair of keys 420 and the pair of key grooves 430, whereby more precise fastening may be performed.

On the other hand, the system may further include an injection unit 700 that is provided on one side of the inside of the moving unit 300 to receive the radioactive waste from an outside and to inject the radioactive waste into the drum unit 200.

The controller (not shown) controls the fastening unit 600 and the injection unit 700 to move to a position where the drum unit 200 is seated by controlling positions of the fastening unit 600 and the injection unit 700, wherein the controller controls the positions according to an operator's decision by being interlocked with a controller provided to an operator.

Here, the controller (not shown) may control the gripping part 610 to move the cover unit 400, may control each of the tool parts 620 to perform tightening associated one of the tightening units 500, or may control the position of the injection unit 700 to inject the radioactive waste into the drum unit 200.

Here, the lengths of the fastening unit 600 and the injection unit 700 may be precisely adjusted through the controller (not shown) by being connected to length adjusting means such as a cylinder and the like, or may be precisely rotated through the controller (not shown) by being connected to a rotating means such as a rotating motor or the like.

That is, the controller (not shown) is capable of moving the fastening unit 600 and the injection unit 700 to the position where the drum unit 200 is seated in the front and back directions, left and right directions, and up and down directions. Accordingly, the operator may unmannedly control a process even without being approached close to the drum unit 200 in which the radioactive waste is stored, so that the problem of exposure to radioactivity may be prevented.

Therefore, according to the system for closing the drum unit for storing radioactive waste of the present disclosure, there is an effect in that the top part of the drum unit for storing the radioactive waste may be unmannedly closed through the tightening units provided in the cover unit.

In addition, when each of the tool parts rotates to tighten associated one of the fastening bolts, there is an effect in that precise fastening of each of the tightening units may be performed through the pair of keys and the pair of key grooves.

The embodiments described in the present specification and the configurations shown in the drawings are only the most exemplary embodiment of the present disclosure and do not represent all the technical spirit of the present disclosure, so it should be understood that there may be various equivalents and variations that may be substituted for the embodiments at the time of the present application.

What is claimed is:

1. A system for closing a drum unit for storing radioactive waste, the system comprising:

a supporting unit configured to be seated on the ground;

a drum unit configured to be seated on a top part of the supporting unit and having a plurality of first fastening holes formed along an outer circumferential surface of a top part thereof;

a moving unit configured to move to a side of the drum unit;

a cover unit provided at an inside of the moving unit or at one side of the drum unit and having a plurality of second fastening holes formed along an outer circumferential surface thereof;

tightening units configured to be inserted into the associated second fastening holes;

a fastening unit configured to grip the cover unit through a gripping part provided on one side of the inside of the moving unit and to move the cover unit to the top part of the drum unit simultaneously and to allow the cover unit to be seated by aligning axis lines of the first and second fastening holes to be matched, thereby closing a gap between the drum unit and the cover unit by tightening an upper part of each of the tightening units through associated one of a plurality of tool parts provided on a circumference of the gripping part; and a controller configured to control the fastening unit.

2. The system of claim 1, wherein each of the tightening units includes:

a fastening bolt having a bolt head formed on an upper part thereof and a first screw thread formed on a lower part thereof;

a first bushing having: a hollow first insertion portion into which the fastening bolt is inserted; a first step formed under the first insertion portion; and first latching portions formed so as to be symmetrical to each other in front and rear directions at a bottom part of the first step;

a second bushing having: a hollow second insertion portion, into which outer circumferential surfaces of the first latching portions are inserted, and having a top part thereof being latched on the first step; and a plurality of fixing pieces configured as a plurality of incision portions on a circumference of a lower part of the second insertion portion; and a third bushing having: second latching portions formed so as to be symmetrical to each other in left and right directions at an upper part thereof, and inserted into the first latching portions; a second step formed at a part under the second latching portions; and a third hollow insertion portion formed under the second step.

3. The system of claim 2, wherein, when one of the tool parts tightens the bolt head, the third insertion portion formed with a second screw thread on an inner circumferential surface thereof moves to an upper part of the fastening bolt along the first screw thread, and at the same time, the second step presses a bottom part of each of the fixing pieces, and each of the fixing pieces subsequently spreads outward with a boundary line, which is formed at an upper end of each of the incision portions, as a reference, so as to surround an area around a bottom part of the first fastening hole, whereby the drum unit and the cover unit are closed.

4. The system of claim 2, wherein the second step is configured to be tapered at a predetermined angle in a direction from a bottom part to a top part.

5. The system of claim 2, wherein a pair of keys are provided at a lower end of each of the tool parts, and a pair of key grooves into which the pair of keys are inserted are provided on an outer circumferential surface of an upper part of the first insertion portion.

6. The system of claim 1, further comprising:

an injection unit provided on the one side of the inside of the moving unit and configured to receive the radioactive waste from an outside to inject the radioactive waste into the drum unit.

7. The system of claim 6, wherein the controller controls positions of the fastening unit and the injection unit so as to move the fastening unit and the injection unit to a position where the drum unit is seated.

8. The system of claim 1, wherein the gripping part is provided with an electromagnet, and the cover unit is made of steel material so that the gripping part grips a top part of the cover unit by a magnetic force of the electromagnet.

* * * * *